United States Patent [19]

Cody et al.

[11] Patent Number: 5,059,299

[45] Date of Patent: Oct. 22, 1991

[54] METHOD FOR ISOMERIZING WAX TO LUBE BASE OILS

[75] Inventors: Ian A. Cody, Clearwater; James D. Bell, Port Moody; Theodore H. West, Sarnia, all of Canada; William A. Wachter, Baton Rouge, La.; Biddanda U. Achia, Clearwater, Canada

[73] Assignee: Exxon Research and Engineering Company, Florham Park, N.J.

[21] Appl. No.: 522,275

[22] Filed: May 11, 1990

Related U.S. Application Data

[63] Continuation of Ser. No. 283,664, Dec. 13, 1988, abandoned, which is a continuation-in-part of Ser. No. 135,150, Dec. 18, 1987, abandoned.

[51] Int. Cl.[5] ..... C10G 73/06

[52] U.S. Cl. ..... 208/27; 208/18; 208/33; 208/46; 208/89; 585/737; 585/749

[58] Field of Search ..... 208/57, 33, 46, 111, 208/143, 144, 97, 89; 585/738, 739, 751, 734, 749

[56] References Cited

U.S. PATENT DOCUMENTS

| | | | |
|---|---|---|---|
| 2,668,790 | 2/1954 | Good et al. | 196/50 |
| 2,668,866 | 2/1954 | Good et al. | 260/683.5 |
| 2,817,693 | 12/1957 | Koome et al. | 260/683.5 |
| 2,914,461 | 11/1959 | Burton et al. | 208/138 |
| 3,078,323 | 2/1963 | Kline et al. | 260/683.65 |
| 3,123,573 | 3/1964 | Carr | 252/442 |
| 3,206,525 | 9/1965 | Michaels et al. | 260/683.66 |
| 3,239,446 | 3/1966 | Demeester | 208/33 |
| 3,268,439 | 8/1966 | Tupman et al. | 208/112 |
| 3,308,052 | 3/1967 | Ireland et al. | 208/27 |
| 3,365,390 | 1/1968 | Egan et al. | 208/60 |
| 3,486,993 | 12/1969 | Egan et al. | 208/89 |
| 3,487,005 | 12/1969 | Egan et al. | 208/59 |
| 3m494,854 | 2/1970 | Gallagher et al. | 208/59 |
| 3,654,130 | 4/1972 | Voorhies et al. | 208/57 |
| 3,663,422 | 5/1972 | Dun et al. | 208/28 |
| 3,684,695 | 8/1972 | Neal et al. | 208/110 |
| 3,692,697 | 9/1972 | Kravitz et al. | 252/439 |
| 3,709,817 | 1/1973 | Suggitt et al. | 208/112 |
| 3,711,399 | 1/1973 | Estes et al. | 208/112 |
| 3,717,586 | 2/1973 | Suggitt et al. | 252/439 |
| 3,794,854 | 2/1974 | Ladeur et al. | 208/110 |
| 3,830,723 | 8/1974 | Ladeur et al. | 208/108 |
| 3,843,746 | 10/1974 | Kravitz et al. | 260/686.68 |
| 3,852,207 | 12/1974 | Stangeland et al. | 208/58 |
| 3,915,843 | 10/1975 | Franck et al. | 206/112 |
| 4,100,056 | 7/1978 | Reynolds | 208/18 |
| 4,472,529 | 9/1984 | Johnson et al. | 502/228 |
| 4,919,786 | 4/1990 | Hamner et al. | 208/46 |

FOREIGN PATENT DOCUMENTS

| | | |
|---|---|---|
| 539698 | 4/1957 | Canada . |
| 700237 | 12/1964 | Canada . |
| 823010 | 11/1959 | United Kingdom . |
| 848198 | 9/1960 | United Kingdom . |
| 953188 | 3/1964 | United Kingdom . |
| 953189 | 3/1964 | United Kingdom . |
| 956685 | 4/1964 | United Kingdom . |
| 1065205 | 12/1965 | United Kingdom . |
| 1342499 | 1/1974 | United Kingdom . |
| 1342500 | 1/1974 | United Kingdom . |
| 1381004 | 1/1975 | United Kingdom . |
| 1440230 | 6/1976 | United Kingdom . |
| 1460478 | 6/1977 | United Kingdom . |
| 1493928 | 11/1977 | United Kingdom . |

*Primary Examiner*—Anthony McFarlane

*Attorney, Agent, or Firm*—Joseph J. Allocca

[57] ABSTRACT

Slack waxes and synthetic wax are isomerized and processed into high viscosity index and very low pour point lube base stock oils and blending stocks by the process comprising the steps of hydrotreating the wax, if necessary, to remove heteroatom and polynuclear aromatic compounds and/or deoiling the wax, if necessary, to an oil content between about 5-20% oil, isomerizing the wax over a Group VI-Group VIII on halogenated refractory metal oxide support catalyst, said isomerization being conducted to a level of conversion such that ~40% and less unconverted wax remains in the 330° C.+, preferably the 370° C.+ fraction sent to the dewaxer. The total isomerate from the isomerization unit is fractionated into a lube oil fraction boiling at 330° C.+, preferably 370°p9 C.+. This oil fraction is solvent dewaxed preferably using MEK/MIBK at 20/80 ratio and unconverted wax is recycled to the isomerization unit. Operating in this manner permits one to obtain isomerate oil of very high VI (in excess of 130) possessing low pours (−21° C., preferably −24° C., most preferably −27° C.).

17 Claims, 3 Drawing Sheets

METHOD FOR ISOMERIZING WAX TO LUBE BASE OILS

CROSS REFERENCE TO RELATED APPLICATIONS

This is a continuation of application Ser. No. 283,664 filed Dec. 13, 1988 now abandoned, which is a continuation-in-part application of Ser. No. 135,150, filed Dec. 18, 1987 now abandoned.

BRIEF DESCRIPTION OF THE INVENTION

A process is disclosed for the production of non-conventional lube oil base stocks or blending stocks of very low pour point, pour point of about −21° C. or lower, preferably about −24° C. or lower, said pour points being achieved by conventional dewaxing techniques without resort to deep dewaxing procedures, and very high viscosity index (VI), VI's of about 130, and higher, preferably 135 and higher by the isomerization of waxes over isomerization catalysts in an isomerization unit to a level of conversion such that about 40% and less, preferably 15–35%, most preferably 20–30% unconverted wax remains in the fraction of the isomerate boiling in the lube boiling range sent to the dewaxing unit calculated as (unconverted wax)/(unconverted wax+dewaxed oil)X100. For the purposes of this application the amount of unconverted wax in the 370° C.+ oil fraction is taken to be the amount of wax removed or recovered from said oil fraction upon dewaxing. The total product from the isomerization (isom) unit is fractionated into a lube oil fraction boiling in the 330° C.+ range, preferably in the 370° C.+ range. This lube oil fraction is solvent dewaxed preferably using 20/80 mixture of MEK/MIBK and unconverted wax is recycled to the isomerization unit.

DETAILED DESCRIPTION OF THE INVENTION

Figure 1:
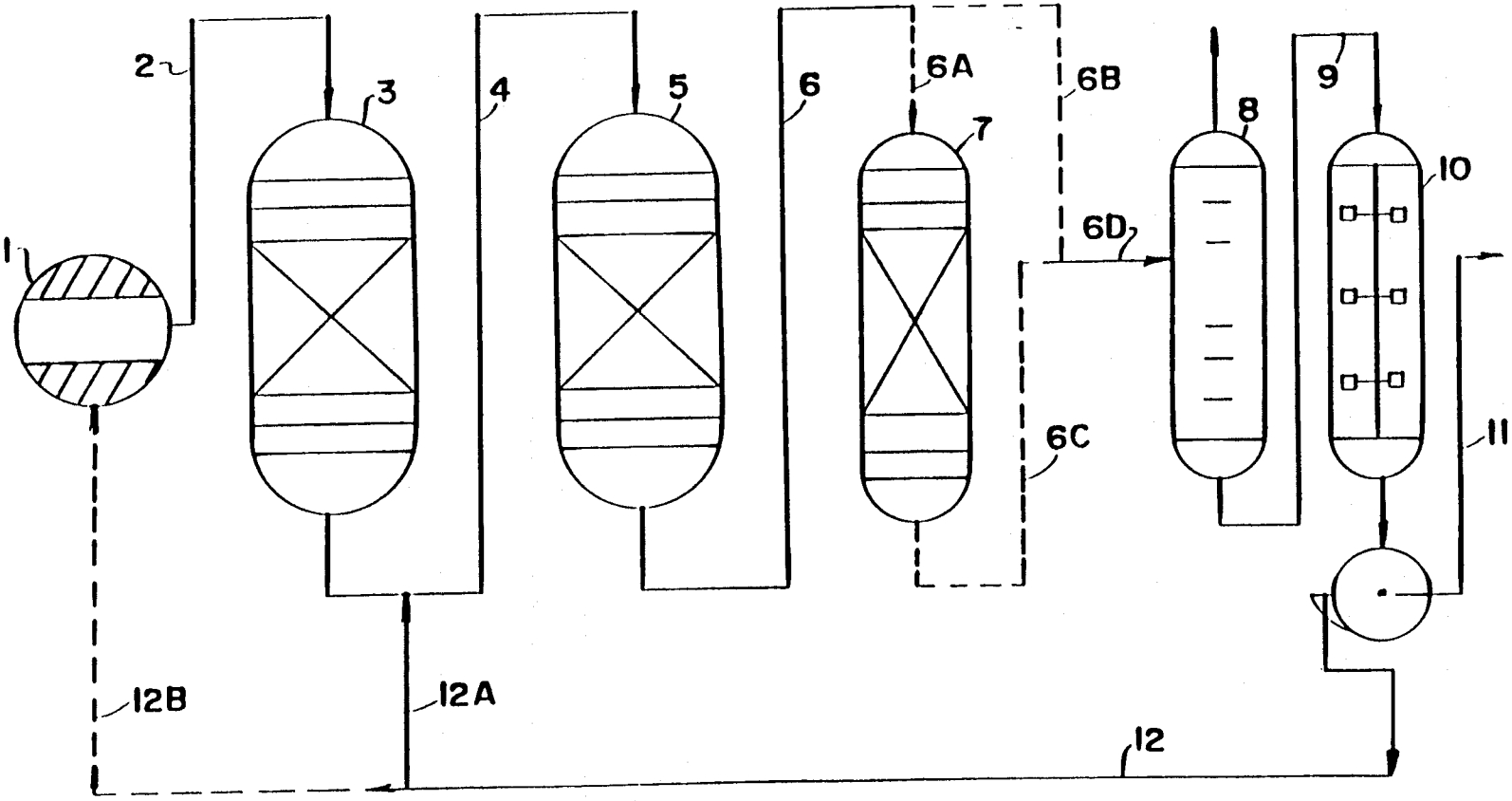
FIG. 1 is a schematic of the step sequences of the process of the present invention.

The present invention is directed to a process for the production of non-conventional lube oil base stocks or blending stocks of very low pour point, pour point of about −21° C. or lower, preferably about −24° C. or lower, said pour points being achieved by conventional dewaxing techniques without resort to deep dewaxing procedures, and very high viscosity index (VI), VI's of about 130 and higher, preferably 135 and higher by the isomerization of waxes over isomerization catalysts in an isomerization unit to a level of conversion such that about 40% and less, preferably 15–35%, most preferably 20–30% unconverted wax remains in the fraction of the isomerate boiling in the lube boiling range sent to the dewaxing unit calculated as (unconverted wax)/(unconverted wax+dewaxed oil)X100. For the purposes of this application the amount of unconverted wax in the 370° C.+ fraction is taken to be the amount of wax removed or recovered from said oil fraction upon dewaxing. The total product from the isomerization (isom) unit is fractionated into a lube oil fraction boiling in the 330° C.+ range, preferably in the 370° C.+ range. This lube oil fraction is solvent dewaxed preferably using 20/80 mixture of MEK/MIBK and unconverted wax is recycled to the isomerization unit.

Operating the isomerization unit at a level of conversion such that the oil fraction sent to the dewaxer contains about 40% and less wax, preferably 15–35% wax, most preferably 20–30% unconverted wax goes against the conventional wisdom of isomerization operations. Lower levels of conversion, i.e. those levels at which a substantial portion of wax remains unconverted in the lube oil fraction sent to the dewaxer (and is subsequently recovered at the dewaxer for recycle) are typically seen as favoring maximization of lube oil production since operation at lower levels of conversion tend to favor the production of lube oil as compared to lower boiling fuels. The amount of wax present in the oil sent to the dewaxer normally should have no significant impact on the dewaxability of the oil or the pour point which can be achieved. There may be a point beyond which so much wax is present as to be beyond the ability of the dewaxer to handle the volume of waxy oil but this traditionally is a materials handling problem and does not affect the ability of the dewaxer to dewax oil to the desired pour point using conventional dewaxing techniques and temperatures. High levels of conversion however tend to produce larger quantities of fuels.

It has been discovered, that at low levels of conversion difficulty is encountered in producing a lube oil having a pour point of at least −21° C. from wax isomerate. To produce a lube oil fraction which can be easily dewaxed to a pour point of at least −21° C. it has been found that the isomerization unit should be run at a level of wax conversion such that about 40% and less, preferably 15–35%, most preferably 20–30% unconverted wax is in the lube fraction sent to the dewaxer.

Figure 3:
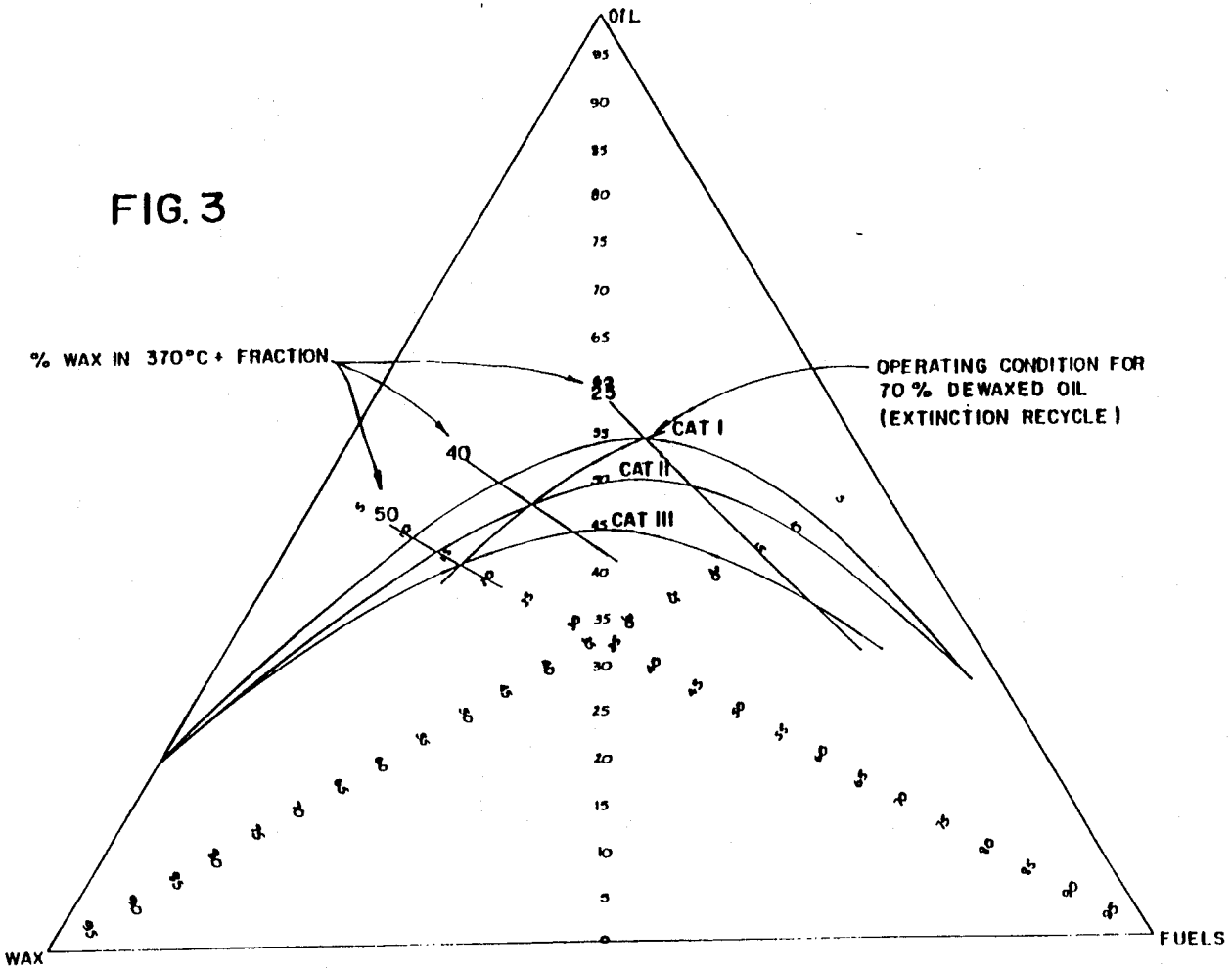
FIG. 3 illustrates the conversion behavior for three different Pt F/$Al_2O_3$ catalysts on a light slack wax (obtained from 600N raffinate) containing about 22% oil.

In FIG. 3, the shape of the curves on the ternary diagram are a measure of the selectivity for converting wax into oil (e.g. 370° C.+ oil) and fuels (e.g. product boiling below 370° C.−). These curves were generated by running the catalysts on a 600N wax feed at conditions of 1000 psi $H_2$, 0.9 V/V/hr, 5000 SCF/bbl, $H_2$, and temperatures ranging from 280°–360° C.

The most selective catalysts produce higher oil yields and less fuel at any given residual wax level. Catalyst I (Catalyst 1 of Example 4 herein) produces a maximum once through oil yield of almost 55, wt. % on feed. Catalysts II (catalyst 8 of Example 5 herein) and III (comparison catalyst 1 of Example 5) produce maximum once-through oil yields of about 50 and about 45 wt. % respectively. Though the curves represent catalyst selectivity on a once through operation, they are a good guide to performance in a recycle-to-extinction process.

In principle a wax extinction process for maximizing lube yields would involve operation at a very low severity i.e. where conversion to fuels is at a minimum. Under these circumstances the amount of unconverted wax recycled to the isomerization reactor would be large and differences in catalyst selectivity would be less important.

In practice however, it is not possible to operate in a low conversion mode. Instead, the operating severity is governed by the need to make a low pour (≦−21° C. pour point) oil. It has been discovered that low pours cannot be achieved from isomerates made at low conversion. This is unexpected since with natural oils the amount of wax present did not effect the ability to dewax the oil to low target pour point. A critical determinant in reaching low pours is that the amount of wax remaining in the 370C.+ fraction obtained from isomerization should not exceed 40% and for lower pour points may have to be as little as 25%. To maximize yield in this situation the choice of catalyst becomes important.

As wax in 370C.+ oil product declines from 50 to 25%, (FIG. 3), the ratio of oil to fuels decreases. This trend is much more pronounced with the least selective catalyst III. This is also illustrated in the Table below. All yields are based on a once through operation.

| | Catalyst | | | | | | | | |
|---|---|---|---|---|---|---|---|---|---|
| | I | | | II | | | III | | |
| % Wax in oil product | 25 | 40 | 50 | 25 | 40 | 50 | 25 | 40 | 50 |
| Wax left (% of feed) | 18.5 | 34 | 44.5 | 17 | 32 | 43 | 12 | 30 | 42 |
| Oil yield (% of feed) | 54.5 | 50 | 44.5 | 49.5 | 48 | 43 | 36 | 45 | 42 |
| Fuels Yield (% of feed) | 27.0 | 16 | 10 | 33.5 | 20 | 14 | 52 | 25 | 16 |

The full recycle oil yields for catalysts I, II and III, in which wax is recycled to extinction, can be predicted assuming the same conversion selectivity applies for recycled wax. On this basis, the yield distinctions between catalysts are even more pronounced.

| | Catalyst | | | | | | | | |
|---|---|---|---|---|---|---|---|---|---|
| | I | | | II | | | III | | |
| % Wax in oil (once-through) | 25 | 40 | 50 | 25 | 40 | 50 | 25 | 40 | 50 |
| Predicted extinction recycle yield of 370 C.+ oil | 69 | 78 | 82 | 60 | 72 | 79 | 40 | 62 | 72 |

At a 25% wax in oil conversion level, Catalyst I is actually 70% more selective for oil than Catalyst III in an extinction recycle process. Thus small differences in catalyst selectivity identified in once through operations can translate into significant yield differences in a recycle process.

Another way to express the different performance of each catalyst is to determine the reaction severity required to achieve a particular target oil yield in a full recycle operation. For the target of 70% oil yield shown in FIG. 1 catalyst I converts much more wax into oil than does catalyst III (i.e. there is less unconverted wax remaining in catalyst I product). In this case, catalyst III cannot simultaneously meet a target yield of 70% oil and a target of $\leqq -21°$ C. pour point, since the amount of unreacted wax in oil exceeds 40%.

The wax which is isomerized may come from any of a number of sources. Synthetic waxes from Fischer-Tropsch processes may be used, as may be waxes recovered from the solvent or autorefrigerative dewaxing of conventional hydrocarbon oils as well as mixtures of these waxes. Waxes from dewaxing conventional hydrocarbon oils are commonly called slack waxes and usually contain an appreciable amount of oil. The oil content of these slack waxes can range anywhere from 0 to 45% or more, usually 5 to 30% oil. For the purposes of this application, the waxes are divided into two categories: (1) light paraffinic waxes boiling in the range about 300°-580° C. and (2) heavy micro waxes having a substantial fraction (>50%) boiling above 600° C.

Isomerization is conducted over a catalyst containing a hydrogenating metal component typically one from Group VI or Group VIII or mixtures thereof, preferably Group VIII, more preferably noble Group VIII most preferably platinum on a halogenated refractory metal oxide support. The catalyst typically contains from 0.1-5.0 wt. % metal, preferably 0.1 to 1.0 wt. % metal, most preferably 0.2-0.6 wt. % metal. The refractory metal oxide support is typically a transition e.g. gamma or eta alumina and the halogen is most usually fluorine.

Preferred catalysts are the subject of copending application, U.S. Ser. No. 283,709 now U.S. Pat. No. 4,959,337 filed even date herewith, which is a continuation-in-part of U.S. Ser. No. 134,795, filed Dec. 18, 1987 in the names of Cody, Sawyer, Hamner and Davis. The use of these catalysts for the production of a lube oil base stock or blending stock by the isomerization of wax is the subject of copending application Attorney Docket OP-3388, U.S. Ser. No. 283,665, now U.S. Pat. No. 4,929,795 filed even date herewith, which is a continuation-in-part of U.S. Ser. No. 134,952, filed Dec. 18, 1987 in the names of Cody, Hamner and Schorfheide.

The catalyst of, U.S. Ser. No. 283,709 now U.S. Pat. No. 4,959,337, contains a hydrogenation metal component which is a Group VIII metal or mixtures thereof, preferably noble Group VIII metal, most preferably platinum on a fluorided alumina or material containing alumina, preferably alumina or material consisting predominantly (i.e. >50%) of alumina, most preferably gamma or eta alumina wherein said catalyst in its as introduced to waxy feed form is characterized by possessing (1) a hydrate level of 60 or less, preferably 10 to 60 determined as the relative amount of hydrate represented by a peak in the X-ray diffraction (XRD) pattern at 20=5.66 Å when a hydrate level of 100 corresponds to the XRD peak height exhibited by a standard material constituting 0.6 wt % Pt on 150 $m^2/g$ $\gamma$ alumina containing 7.2 wt % F wherein the fluorine has been deposited using an aqueous solution containing a high concentration of HF, i.e. 10 wt % HF and greater, preferably 10 to 15 wt % HF and the material dried at 150° C. for 16 hrs; (2) a surface nitrogen content N/Al ratio of 0.01 or less, preferably 0.007 or less, most preferably 0.004 or less as determined by X-ray photoelectron spectroscopy (XPS); (3) a bulk fluorine concentration of about 2 to 20 wt % and (4) a surface fluorine present in a layer extending from the surface of the particle (e.g. 1/16 inch extrudates) to a depth of 1/100 inch, of less than 3 wt %, preferably less than 1 wt %, most preferably less than 0.5 wt % fluorine in that zone provided that the surface fluoride concentration is less than the bulk fluoride concentration.

The fluoride content of the catalyst can be determined in a number of ways.

One technique analyzes the fluorided catalyst using oxygen combustion methodology which is well established in the literature. Approximately 8-10 mgs of sample is mixed with 0.1 g benzoic acid and 1.2 gms of mineral oil in a stainless steel combustion capsule which is mounted in a 300 mL. Parr oxygen combustion bomb. The "sample" is purged of air and subsequently combusted under 30 Atms of pure oxygen. Combustion products are collected in 5 mL. of deionized water. Once the reaction has gone to completion (about 15 minutes), the absorbing solution is quantitatively transferred and made to fixed volume.

Fluoride concentration of the sample is determined by ion chromatography analysis of the combustion product solution. Calibration curves are prepared by combusting several concentrations of ethanolic KF standards (in the same manner as the sample) to obtain a 0–10 ppm calibration range. Fluoride concentration of the catalyst is calculated on an ignition-loss-free-basis by comparison of the sample solution response to that of the calibration curve. Ignition loss is determined on a separate sample heated to 800 degrees F. for at least 2 hours. Ion chromatographic analysis uses standard anion conditions.

Another procedure employs the use of fluoride distillation with a titrimetric finish. Fluorides are converted into fluorosilicic acid ($H_2SiF_6$) by reaction with quartz in phosphoric acid medium, and distilled as such using super heated steam. This is the Willard-Winter-Tananaev distillation. It should be noted that the use of super heated, dry (rather than wet) steam is crucial in obtaining accurate results. Using a wet steam generator yielded results 10–20% lower. The collected fluorosilicic acid is titrated with standardized sodium hydroxide solution. A correction has to be made for the phosphoric acid which is also transferred by the steam. Fluoride data are reported on an ignition-loss-free-basis after determination of ignition loss on a sample heated to 400 degree C. for 1 hour.

Another preferred catalyst described in U.S. Ser. No. 283,709 now U.S. Pat. No. 4,959,337 is a catalyst prepared by a process involving depositing a hydrogenation metal on an alumina or material containing alumina support, calcining said metal loaded support typically at between 350° to 500° C., preferably about 450° to 500° C. for about 1 to 5 hrs, preferably about 1 to 3 hrs and fluoriding said metal loaded support using a high pH fluorine source solution to a bulk fluorine level of about 8 wt % or less, (i.e. 2 to 8 wt %) preferably about 7 wt % or less, said high pH source solution being at a pH or 3.5 to 4.5 and preferably being a mixture of $NH_4F$ and HF followed by rapid drying/heating in a thin bed or rotary kiln to insure thorough even heating in air, oxygen containing atmosphere or an inert atmosphere to a temperature between about 350° to 450° C. in about 3 hours or less, preferably 375° to 400° C. and holding at the final temperature, if necessary, for a time sufficient to reduce the hydrate and nitrogen content to the aforesaid levels, e.g. holding for 1 to 5 hours or using a low pH fluorine source solution having a pH of less than 3.5 to a bulk fluorine level of about 10 wt % or less, (i.e. 2 to 10 wt %) preferably about 8 wt % or less followed by drying/heating in a thin bed or rotary kiln to a temperature of about 350° to 450° C., preferably 375 to 425° C. and holding, if desired, at that temperature for 1 to 5 hours, in air, an oxygen containing atmosphere, or inert atmosphere. The alumina or alumina containing support material is preferably in the form of extrudates and are preferably at least about 1/32 inch across the longest cross sectional dimension. If the catalyst is first charged to a unit, heating a dense bed charge of catalyst will be for a longer period, longer than 5 hours, preferably longer than 10 hours and preferably at temperatures of 400° to 450° C.

The above catalysts typically contain from 0.1 to 5.0 wt % metal, preferably 0.1 to 1.0 wt % metal, most preferably 0.2 to 0.6 wt % metal.

The dried/heated catalyst has a surface nitrogen content N/Al of 0.01 or less by X-ray photoelectron spectroscopy (XPS), preferably an N/Al of 0.007 or less, most preferably an N/Al of 0.004 or less by XPS.

The catalyst, following the above recited heating step, can be charged to the isomerization reactor and brought quickly up to operating conditions. Alternatively following the above recited heating step the catalyst prepared using the pH 3.5–4.5 solution technique can be activated preferably in pure or plant hydrogen (60–70 vol % $H_2$) at 350° to 450° C., care being taken to employ short activation times, from 1 to 24 hours, preferably 2 to 10 hours being sufficient. Long activation times (in excess of 24 hours) have been found to be detrimental to catalyst performance. By way of comparison, catalysts made using solutions of pH less than 3.5 can be activated in pure or plant hydrogen at 350° to 500° C. for from 1 to 48 hours or longer. In fact, if catalysts prepared using solutions of pH 3.5 or less are not heated first, then it is preferred that they be subsequently activated at more severe conditions, i.e. for longer times and/or at higher temperatures. On the other hand, if they are heated first, then moderate activation procedures similar to those employed with catalysts made from the higher pH solution treatment will suffice.

A typical activation profile shows a period of 2 hours to go from room temperature to 100° C. with the catalyst being held at 100° C. for 0 to 2 hours then the temperature is raised from 100 to about 350 over a period of 1 to 3 hours with a hold at the final temperature of from 1–4 hours. Alternatively the catalyst can be activated by heating from room temperature to the final temperature of 350°–450° C. over a period of 2–7 hours with a hold at the final temperature of 0–4 hours. Similarly activation can be accomplished by going from room temperature to the final temperature of 350°–450° C. in 1 hour.

It is possible to dispense with a separate activation procedure entirely, (provided the catalyst has first been heated in air). In these instances, the calcined catalyst is simply charged to the reactor, heated to just above the melting point of the wax feed, feed and hydrogen introduced onto the catalyst, and thereafter the unit brought quickly up to operation conditions.

Another preferred catalyst is made by the procedure recited in copending application, U.S. Ser. No. 283,658, now U.S. Pat. No. 4,900,407 filed even date herewith, which is a continuation-in-part of U.S. Ser. No. 134,698, filed Dec. 18, 1987 in the names of Cody, Hamner, Sawyer and Schorfheide. The use of this particular catalyst for the production of lube base stock and blending stock by the isomerization of wax is the subject of copending application, U.S. Ser. No. 283,680 now U.S. Pat. No. 4,937,399 filed even date herewith which is a continuation-in-part of U.S. Ser. No. 134,697, filed Dec. 18, 1987 in the names of Wachter, Cody, Hamner and Achia. That catalyst comprises a hydrogenating metal on fluorided alumina or material containing alumina support made by depositing the hydrogenation metal on the support and fluoriding said metal loaded support using acidic fluorine sources such as HF by any convenient technique such as spraying, soaking, incipient wetness, etc. to deposit between 2–10% F. preferably 2–8% F. Following halogenation the catalyst is dried, typically at 120° C. and then crushed to expose inner surfaces, the crushed catalyst and is double sized to remove fines and uncrushed particles. This sieved catalyst is 1/32 inch and less and typically from 1/64 to 1/32 inch in size across its largest cross-sectional dimension.

The starting particle or extrudate may be of any physical configuration. Thus particles such as cylinders, trilobes or quadri lobes may be used. Extrudates of any diameter may be utilized and can be anywhere from 1/32 of an inch to many inches in length, the length dimension being set solely by handling considerations. It is preferred that following sizing the particle have a length smaller than the initial extrudate diameter.

Following deposition of the hydrogenation metal and the fluoriding of the particle or extrudate, the particle or extrudate is crushed or fractured to expose inner surfaces.

The crushing is conducted to an extent appropriate to the particle or extrudate with which one is starting. Thus, an extrudate which is 1 foot long and 1/16 inch in diameter would be sized into pieces which range anywhere from 1/64 to 1/32 inch across its longest cross-sectional dimension. Similarly, if the extrudate is only 1/16 inch to begin with it will be enough simply to break it in half, into two /b 1/32 inch pieces, for example.

Alternatively, one can take a metal loaded support particle which is already about 1/32 inch in size or smaller and fluoride it as described above using HF.

Generally, therefore, the sized material will range in size between about 1/64 to 1/32 inch in size.

The uncalcined sized catalyst is activated in a hydrogen atmosphere such as pure hydrogen or plant hydrogen containing 60 to 70 vol % hydrogen by heating to 350° to 500° C., preferably 350° to 450° C. for from 1 to 48 hours or longer. The hydrogen activation profiles described above may similarly be employed here.

This sized catalyst is unexpectedly superior for wax isomerization as compared to the uncrushed particle or extrudate starting material. It has also been discovered that 370° C.+ oil products made using the sized catalyst as compared to the uncrushed or extrudate material starting with wax possessing about 5–10% oil exhibit higher VI's than do 370° C.+ oil products made starting with wax possessing 0% oil (on the one hand) and about 20% oil (on the other). Therefore, to produce products having the highest VI one would isomerize wax having from 5–15% oil, preferably 7–10% oil using the "sized" catalyst produced using HF.

As one would expect isomerization catalysts are susceptible to deactivation by the presence of heteroatom compounds (i.e. N or S compounds) in the wax feed so care must be exercised to remove such heteroatm materials from the wax feed charges. When dealing with high purity waxes such as synthetic Fischer-Tropsch waxes such precautions may not be necessary. In such cases subjecting such waxes to very mild hydrotreating may be sufficient to insure protection for the isomerization catalyst. On the other hand waxes obtained from natural petroleum sources contain quantities of heteroatom compounds as well as appreciable quantities of oil which contain heteroatom compounds. In such instances the slack waxes should be hydrotreated to reduce the level of heteroatoms compounds to levels commonly accepted in the industry as tolerable for feeds to be exposed to isomerization catalysts. Such levels will typically be a N content of about 1 to 5 ppm and a sulfur content of about 1 to 20 ppm, preferably 2 ppm or less nitrogen and 5 ppm or less sulfur. Similarly such slack waxes should be deoiled prior to hydrotreating to an oil content in the range of 0–35% oil, preferably 5–25% oil. The hydrotreating step will employ typical hydrotreating catalyst such as Co/Mo, Ni/Mo, or Ni/Co/Mo on alumina under standard, commercially accepted conditions, e.g., temperature of 280° to 400° C., space velocity of 0.1 to 2.0 V/V/hr, pressure of from 500 to 3000 psig $H_2$ and hydrogen gas rates of from 500 to 5000 SCF/b.

When dealing with Fischer-Tropsch wax it is preferred, from a processing standpoint, to treat such wax in accordance with the procedure of copending application, U.S. Ser. No. 283,643 filed even date herewith in the names of Hamner, Boucher and Wachter which is a continuation-in-part of U.S. Ser. No. 134,797 filed Dec. 18, 1987. The Fischer-Tropsch wax is treated with a hydrotreating catalyst and hydrogen to reduce the oxygenate and trace metal levels of the wax and to partially hydrocrack/isomerize the wax after which it is hydroisomerized under conditions to convert about 10 to 35 wt % of the hydrotreated Fischer-Tropsch wax to distillate and lighter fractions (650° F.−) by being contacted in a hydroisomerization zone with a fluorided Group VIII metal-on-alumina catalyst having (1) a fluoride concentration ranging from about 2 to 10 percent based on the total weight of the catalyst, wherein the fluoride concentration is less than about 2.0 weight percent at the outer surface to a depth less than one one hundredth of an inch, (2) an aluminum fluoride hydroxide hydrate level greater than 60 where an aluminum fluoride hydroxide hydrate level of 100 corresponds to the X-ray diffraction peak height of 56.66 Å for a reference material containing 0.6 wt % Pt and 7.2 wt % F on $\gamma$ alumina having a surface area of about 150 $m^2g$ prepared by impregnating $\gamma$ alumina containing platinum with an aqueous solution of hydrogen fluoride (11.6 wt % HF solution) followed by drying at 300° F. and (3) a N/Al ratio by XPS of less than about 0.005. In U.S. Ser. No. 283,643 the hydrotreating is under relative severe conditions including a temperature in the range 650° F. to 775° F., (about 343° to 412° C.), a hydrogen pressure between about 500 and 2500 psig, a space velocity of between about 0.1 and 2.0 v/v/hr and a hydrogen gas rate between about 500 and 5000 SCF/bbl. Hydrotreating catalysts include the typical Co/Mo or Ni/Mo on alumina as well as other combinations of Co and/or Ni and Mo and/or W on a silica/alumina base. The hydrotreating catalyst is typically presulfided but it is preferred to employ a non-sulfided hydrotreating catalyst.

In the present invention isomerization of waxes over the above particularly recited isomerization catalysts is conducted to a level of conversion which optimizes the conversion of wax to lube range materials while minimizing production of fuels range materials (i.e. 370° C.− products) yet producing an overall lube oil product which does not contain more unconverted wax than can be efficiently handled by the solvent dewaxing unit i.e. 25–40% wax to the dewaxer.

Isomerization is conducted under conditions of temperatures between about 270° to 400° C., preferably 300°–360° C., pressures of 500 to 3000 psi $H_2$, preferably 1000–1500 psi $H_2$, hydrogen gas rates of 1000 to 10,000 SCF/bbl, and a space velocity in the range 0.1–10 v/v/hr, preferably 1–2 v/v/hr.

Following isomerization the isomerate is fractionated into a lubes cut and fuels cut, the lubes cut being identified as that fraction as that fraction boiling in the 330° C.+ range, preferably the 370° C.+ range or even higher. This lubes fraction is then dewaxed to a pour point of about −21° C. or lower. Dewaxing is accomplished by techniques which permit the recovery of unconverted wax, since in the process of the present invention this unconverted wax is recycled to the isomerization unit. It is preferred that this recycle wax be recycled to the main wax reservoir and be passed through the hydrotreating unit to remove any quantities of entrained dewaxing solvent which solvent could be detrimental to the isomerization catalyst. Alternatively, a separate stripper can be used to remove entrained dewaxing solvent or other contaminants. Since the unconverted wax is to be recycled dewaxing procedures which destroy the way such as catalytic dewaxing are not recommended. Solvent dewaxing is utilized and employs typical dewaxing solvents. Solvent dewaxing utilizes typical dewaxing solvents such as $C_3$–$C_6$ ketones (e.g. methyl ethyl ketone, methyl isobutyl ketone and mixtures thereof), $C_6$–$C_{10}$ aromatic hydrocarbons (e.g. toluene) mixtures of ketones and aromatics (e.g. MEK/-toluene), autorefrigerative solvents such as liquified, normally gaseous $C_2$–$C_4$ hydrocarbons such as propane, propylene, butane, butylene and mixtures thereof, etc. at filter temperature of −25° to −30° C. The preferred solvent to dewax the isomerate especially isomerates derived from the heavier waxes (e.g. bright stock waxes) under miscible conditions and thereby produce the highest yield of dewaxed oil at a high filter rate is a mixture of MEK/MIBK (20/80 v/v) used at a temperature in the range −25° to −30° C. Pour points lower than −21° C. can be achieved using lower filter temperatures and other ratios of said solvents but a penalty is paid because the solvent-feed systems becomes immiscible, causing lower dewaxed oil yields and lower filter rates. Further, when dewaxing isomerate made from a microwax, e.g. Bright Stock slack wax it is preferred that the fraction of the isomerate which is sent to the dewaxer is the "broad heart cut" identified as the fraction boiling between about 330° to 600° C., preferably about 370°–580° C. After such fractionation the fraction sent to the dewaxer has about 40% or less unconverted wax. The heavy bottoms fraction boiling above about 580° to 600° C. contains appreciable wax and can be recycled to the isomerization unit directly. However if any hydrotreating or deoiling is deemed necessary or desirable then the fractionation bottoms are reisomerized by being first sent to the fresh feed reservoir and combined with the wax therein.

One desiring to maximize the production of lube oil having a viscosity in the 5.6 to 5.9 cSt/100° C. range should practice the isomerization process under low hydrogen treat gas rate conditions, treat gas rates on the order of 500 to 5000 SCF/bbl, $H_2$, preferably 2000 to 4000 SCF/bbl, $H_2$, most preferably about 2000 to 3000 SCF/bbl, $H_2$, as is taught in copending application, U.S. Ser. No. 283,684, now abandoned filed even date herewith, which is a continuation-in-part of U.S. Ser. No. 134,998, filed Dec. 18, 1987 in the name of H. A. Boucher.

In copending application U.S. Ser. No. 135,032 filed Dec. 18, 1987 in the names of Glen P. Hamner and S. Mark Davis, it is taught that an increased yield of lube oil base stock or blending stock can be obtained by using palladium on fluorided alumina as the catalyst.

It has also been found that prior to fractionation of the isomerate into various cuts and dewaxing said cuts the total liquid product (TLP) from the isomerization unit can be advantageously treated in a second stage at mild conditions using the isomerization catalyst or simply noble Group VIII on refractory metal oxide catalyst to reduce PNA and other contaminants in the isomerate and thus yield an oil of improved daylight stability. This aspect is covered in U.S. Ser. No. 283,659 filed even date herewith which is a continuation-in-part of U.S. Ser. No. 135,149, filed Dec. 18, 1987 in the names of Cody, MacDonald, Eadie and Hamner.

In that embodiment the total isomerate is passed over a charge of the isomerization catalyst or over just noble Gp VIII on e.g. transition alumina. Mild conditions are used, e.g. a temperature in the range of about 170°–270° C., preferably about 180° to 220° C., at pressures of about 300 to 1500 psi $H_2$, preferably 500 to 1000 psi $H_2$, a hydrogen gas rate of about 500 to 10,000 SCF/bbl, preferably 1000 to 5000 SCF/bbl and a flow velocity of about 0.25 to 10 v/v/hr., preferably about 1–4 v/v/hr. Temperatures at the high end of the range should be employed only when similarly employing pressures at the high end of their recited range. Temperatures in excess of those recited may be employed if pressures in excess of 1500 psi are used, but such high pressures may not be practical or economic.

The total isomerate can be treated under these mild conditions in a separate, dedicated unit or the TLP from the isomerization reactor can be stored in tankage and subsequently passed through the aforementioned isomerization reactor under said mild conditions. It has been found to be unnecessary to fractionate the 1st stage product prior to this mild 2nd stage treatment. Subjecting the whole product to this mild second stage treatment produces an oil product which upon subsequent fractionation and dewaxing yields a base oil exhibiting a high level of daylight stability and oxidation stability. These base oils can be subjected to subsequent hydrofinishing using conventional catalysts such as KF-840 or HDN-30 (e.g. Co/Mo or Ni/Mo on alumina) at conventional conditions to remove undesirable process impurities to further improve product quality.

Figure 2:
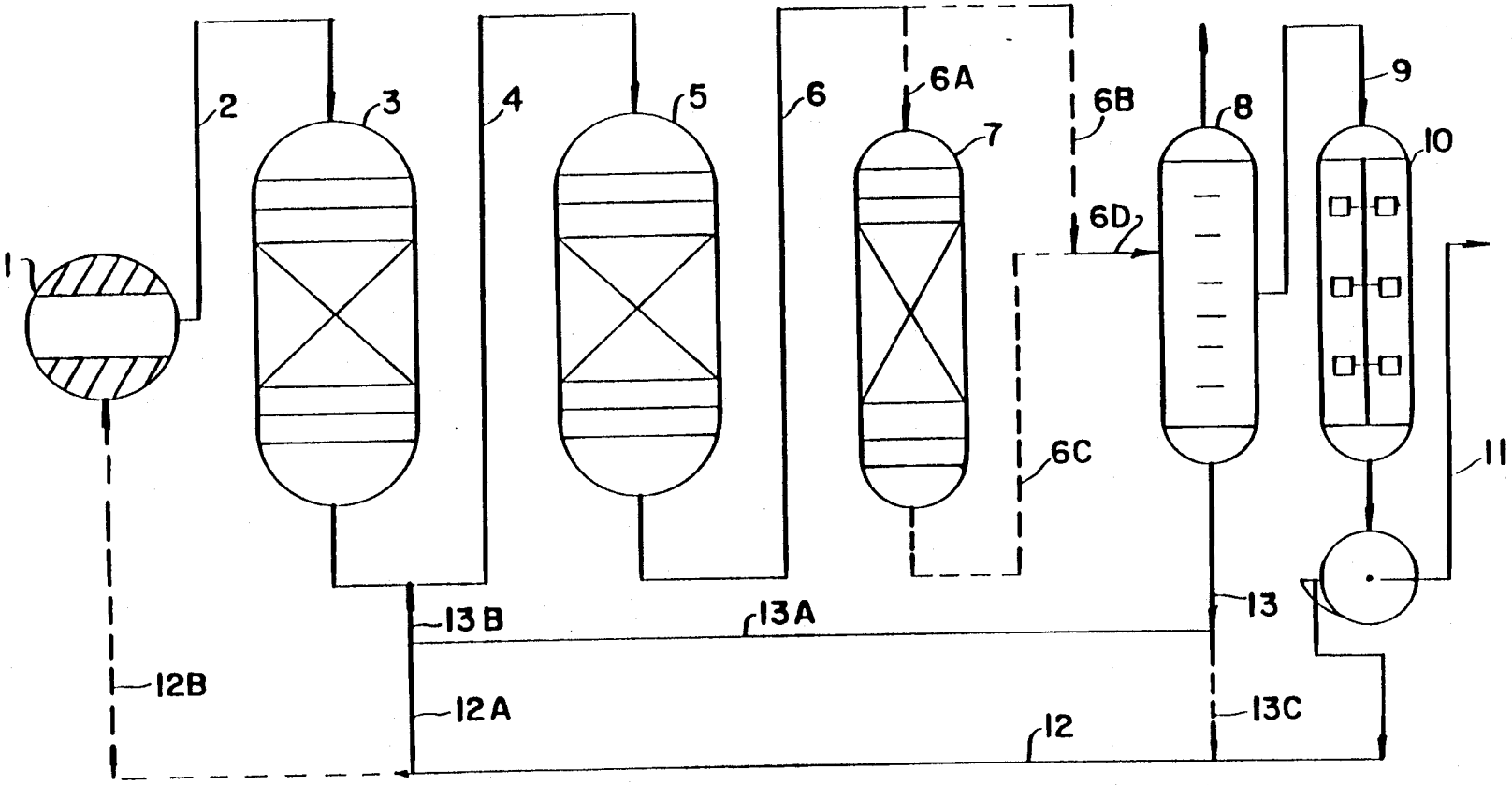
FIG. 2 is a schematic of the step sequences of the process of the present invention including the optional step of waxy fractionator bottoms recycle.

FIGS. 1 and 2 present schematic representations of preferred embodiments of the wax isomerization process.

In FIG. 1, slack wax feed, derived from, for example a lighter oil such as 600N oil or lighter is fed from reservoir (1) to a hydrotreater (3) via line 2 wherein heteroatom compounds are removed from the wax. This hydrotreated slack wax is then fed via line 4 to the isomerization unit (5) after which the total liquid product is fed either directly via lines 6, 6B and 6D to the separation tower (unit 8) for fractionation into a lubes fraction boiling above about 370° C.+ and a light fraction boiling below about 370° C.− or, in the alternative the TLP from the isomerization unit is fed first via lines 6 and 6A to a low temperature, mild condition second stage treating unit (unit 7) wherein the TLP is contacted with the isomerization catalyst or simply a noble Group VIII metal on alumina catalyst to produce a stream which is then sent via lines 6C and 6D to the fractionation tower (unit 8). In either case the lube steam boiling in the 370° C.+ range is then forwarded via line 9 to the solvent dewaxer (unit 10) for the separation of waxy constituents therefrom, the dewaxed oil fraction being recovered via line 11 and if necessary forwarded to other conventional treatment processes normally employed on base stock or blending stock oils. The recovered wax is recycled either directly via line 12 and 12A to the slack wax stream being fed to the isomerization unit or it is recycled to the wax reservoir (1) via line 12B for passage through the hydrotreater prior to being recycled to the isomerization unit.

In FIG. 2 the wax processing stream is much like that of FIG. 1, the main differences being that FIG. 2 represents the scheme for handling heavier slack wax feeds, such as a wax feed derived from Bright Stock oil. In such a case the wax from reservoir 1 is fed via line 2 to the hydrotreater (3) prior to being sent via line 4 to the isomerization unit (unit 5) after which it is either fed via lines 6 and 6A to a low temperature mild condition second stage treating unit (unit 7) wherein it is contacted with a further charge of isomerization catalyst or simply noble Group VIII metal on alumina and fed via lines 6C and 6D to the fractionator tower (unit 8), or fed directly via lines 6, 6B and 6D to the fractionation tower (unit 8). In the fractionation tower the isomerate made using the heavy wax is fractionated into a light fraction boiling in the 370° C.− (a fuels cut) a lube cut boiling in the 370° C.+ range and a bottoms fraction boiling in the 580° C.+ range. The lubes fraction, a broad cut boiling in the 370° C. to 580° C. range is sent via line 9 to the dewaxer (unit 10) as previously described. The 580° C.+ bottoms fraction contains appreciable wax and is recycled via line 13, 13A, 13B and 4 to the isomerization unit (5). This bottoms fraction optionally can be combined via line 13 and 13C with the wax in line 12 recovered from the dewaxing unit (10) in which case this total recycled stream can be fed directly to the isomerization unit via lines 12A, 13B and 4 or it can be sent to the wax reservoir (1) via lines 12B for treatment in the hydrotreater prior to being fed to the isomerization unit.

The invention will be better understood by reference to the following examples which either demonstrate the invention or are offered for comparison purposes.

EXAMPLES

Example 1

Catalyst 1

A synthetic hydrocarbon synthesis wax (a Fischer-Tropsch wax, characterized as being 100% 370° C.+ material possessing a melting point in the range 104° to 110° C., a mean carbon number (from viscosity data) of about 65 carbons, a boiling range of about 450°-650° C. (initial to 70 LV% off by GCD) and a kinematic viscosity of 9.69, was isomerized over a 14/35 meshed platinum on fluorided alumina catalyst made by first fluoriding a platinum loaded 1/16" alumina extrudate (0.6 wt. % platinum) using a 11.6 wt % aqueous HF solution (by soaking) after which the fluorided metal loaded extrudate was washed with 10 fold excess water and dried at 150C. in vac. oven. The metal loaded fluorided extrudate was not calcined. It was crushed to produce particles of about 1/30" (meshed to 14/35). Catalyst 1 had a fluorine content of 8.3 wt %.

The sized catalyst, Catalyst 1, was activated by heating to 450° C. in 50 psi flowing $H_2$ in the following manner: room temperature to 100° C. in 2 hours, hold at 100° C. for 1 hour; heat from 100° C. to 450° C. in 3 hours, hold at 450° C. for 1 hour.

TABLE 1

DEWAXING FISCHER-TROPSCH SYNTHETIC WAX HYDROISOMERATES (370° C.+)

| Isomerization, Conditions | | |
|---|---|---|
| Pressure, psi $H_2$ | 1000 | 1000 |
| space velocity (v/v/hr) | 1.0 | 1.0 |
| gas treat rate (SCF/bbl, $H_2$) | 7500 | 7500 |
| Temp., °C. | 375-378 | 380.5 |
| Time on stream (hrs) | 4082-4584 | 4981-5287 |

TABLE 1-continued

DEWAXING FISCHER-TROPSCH SYNTHETIC WAX HYDROISOMERATES (370° C.+)

| Conversion Level | (LOW) | (HIGH) |
|---|---|---|
| Wt % 370° C.− | 13 | 19 |
| Waxy Product Properties | 98 | 86 |
| Cloud °C. | | |
| Dewaxing Conditions | | |
| Solvent: | 40/60 V/V MEK/TOLUENE | |
| Dilution: | 4 V/V on Waxy Feed | |
| Filter Temperature, °C. | −30 | −30 |
| Viscosity, cSt @ 100° C. | 7.3 | 6.5 |
| Dewaxed Oil Properties | | |
| Pour, °C. | −13 | −20 |
| Pour-Filter DT °C. | 17 | 10 |
| Viscosity, cSt @ 40° C. | 39 | 33.8 |
| Viscosity, cSt @ 100° C. | 7.5 | 6.7 |
| Viscosity Index | 163 | 159 |
| Wt % Wax Recovered from 370° C.+ Oil | 48 | 30 |

It is apparent that at low levels of conversion, where large quantities of unconverted wax remain in the 370° C.+ oil to the dewaxer, it is not possible to achieve a low pour (i.e. about −21° C.) using typical dewaxing solvents under standard conditions (i.e. filter temperature of −30° C.). Lower pour point could be achieved if one were to go to extremely low filter temperature such as −40° C., but this puts strains on the refrigeration capability of the plant as well as possible being beyond the metallurgical limitations of most plants. Operating at higher levels of conversion (e.g. 30% wax in the 370° C.+ fraction to the dewaxer) is seen to facilitate achieving a low pour point while still being within the typical operating parameters of standard dewaxing plants.

EXAMPLE 2

Catalyst 1

Slack wax from 600N oil was isomerized over Catalyst 1 described in Example 1 to three levels of conversion.

The slack wax was first hydrotreated over HDN-30 catalyst (a conventional Ni/Mo on alumina catalyst) at 350° C., 1.0 v/v/hr., 1500 SCF/BBL, $H_2$, 1000 psi ($H_2$). The catalyst had been on stream for 1447-1577 hours. The hydrotreated slack wax had sulfur and nitrogen contents of less than 1 ppm and contained about 23% oil.

TABLE 2

DEWAXING OF ISOMERATES DERIVED FROM 600N SLACK WAX (370° C.+)

| Isomerization Conditions | | | |
|---|---|---|---|
| Pressure, psi | 1000 | 1000 | 1700 |
| Space Velocity (v/v/hr) | 0.9 | 0.9 | 0.9 |
| Gas treat rate (SCF/bbl, $H_2$) | 5000 | 5000 | 5000 |
| Temp. °C. | 318 | 324 | 327 |
| Conversion Level | (Low) | (Medium) | (High) |
| Wt % 370° C.− | 11.8 | 20 | 25.8 |
| Dewaxer Feed Cloud, °C. | 60 | 54 | 49 |
| Dewaxing Conditions (Batch Conditions) | | | |
| Solvent: | | 100% MIBK | |
| Dilution Solvent/Feed/v/v | 5.1 | 3.5 | 3.4 |
| Filter Temperature, °C. | −25 | −25 | −25 |
| Viscosity, CS @ 100° C. | 5.63 | 5.03 | 4.61 |
| Dewaxed Oil Properties | | | |
| Pour Point, °C. | −14 | −19 | −23 |
| Pour-Filter T °C. | 11 | 6 | 2 |

TABLE 2-continued

| DEWAXING OF ISOMERATES DERIVED FROM 600N SLACK WAX (370° C.+) | | | |
|---|---|---|---|
| Viscosity, cSt @ 40° C. | 27.6 | 22.8 | 20.7 |
| Viscosity, cSt @ 100° C. | 5.63 | 5.03 | 4.61 |
| Viscosity Index | 149 | 147 | 144 |
| Wt. % Wax recovered from 370° C.+ oil fraction | 56 | 39 | 30 |

From this it is seen that even for isomerates obtained by isomerizing waxes from a natural petroleum source, the ability to dewax the isomerate to the desired low pour point of at least about −21° C. is dependent upon the level of conversion. Low conversion levels produce isomerate which cannot be dewaxed to a low target pour using conventional dewaxing solvents under typical dewaxing filter temperature conditions.

EXAMPLE 3 (Comparative)

It has been discovered that waxy isomerates behave differently than waxy conventional oils when being dewaxed. With waxy conventional oils the wax content of the oil (usually a solvent extracted distillate) has virtually no impact on the pour point of the dewaxed oil nor on the ease with which that pour point can be achieved. In Table 3 below two typical oils, 150 neutrals having viscosities of about 5.4 cSt @100° C., viscosities very similar to those of the isomerates described in the present text, were solvent dewaxed using ketone solvents. The difference between the two natural oil stocks is wax content; one stock from a South Louisiana crude contains about 9–10% wax, the other stock from a North Louisiana crude contains about 19–22% wax. Both stocks were processed under nearly identical conditions as shown in the Table. Despite the differences in wax content the pour points of the dewaxed oils obtained by dewaxing under nearly identical conditions were identical. Both natural oil stocks were dewaxed in a dewaxing plant employing MEK/MIBK under DILCHILL conditions as described in U.S. Pat. No. 3,773,650 to a temperature of −6° C. Further chilling to the filtration temperature was done employing laboratory scraped surface chilling apparatus. While feed filter rates and wax cake liquids/solids differed, both oils could be dewaxed to about the same pour point using nearly identical dewaxing conditions.

This is to be compared with the results obtained in the prior example wherein dewaxing isomerate of different wax contents under nearly identical dewaxing conditions gave dewaxed oils of different pour points, thus showing the unexpected effect that the wax content of the isomerate has on dewaxing performance.

slack wax was hydrotreated over HDN-30 catalyst at 350° C., 1.0 v/v/hr. 1500 SCF/bbl, $H_2$, 1000 psi $H_2$ or over KF-840 at 340° C., 0.5 v/v/hr., 1000 psi, 1500 SCF/bbl. These hydrotreated waxes had oil contents ranging from 21 to 23%, S ranging from 3 to 10 (ppm), N≦1-(ppm).

This wax feed was contacted with platinum on fluorided alumina produced in the following way.

Catalyst 2 One sixteenth inch γ alumina extrudates impregnated with plantinum were obtained from the commercial supplier containing 0.6 wt. % platinum and 1% chlorine on the extrude. The metal loaded extrudate was then fluorided using a 10 fold excess 11.6 wt% aqueous HF by immersion for 16 hrs. at ambient temperature. The resulting catalyst was washed with 2 fold excess $H_2O$ and dried at 150° C. in vacuum for 16 hrs. The fluoride content was 8.0 wt.%. The sample of Catalyst 2 as charged to the 200 cc unit was activated in 300 psi $H_2$ at 6.3 SCF $H_2$/hr as follows: heat from room temperature to 100° C. at 35° C./hr; hold at 100° C. for 6 hrs; heat from 100° C. to 250° C. at 10° C./hr; hold at 250° C. for 12 hrs; heat to 400° C. at 10° C./hr; hold at 400° C. for 3 hrs. The sample of Catalyst 2 as charged to the 3600 cc unit was activated as follows; at 300 psi $H_2$ at 11 SCF $H_2$/hour per pound of catalyst, heat from room temperature to 100° C. at 10° C./hour; hold at 100° C. for 24 hours; heat from 100° C. to 250° C. at 10° C. per hour; hold at 250° C. for 15 hours; then at 22 SCH $h_2$/hour per pound of catalyst, heat from 250° to 400° C. in 31 hours; hold at 400° C. for 3 hours.

Catalyst 3 was prepared using 1/16 inch γ alumina extrudates impregnated with 0.6 wt % platinum and containing 1.0% chlorine as received from the commercial supplier. The metal loaded extrudate was then fluorided using 5:1 volume excess of 11.6 wt % aqueous HF by immersion for 6 hours at ambient temperature (~25° C.). The resulting material when washed with two-fold excess $H_2O$ and dried at about 120° C. for 16 hrs was designated Catalyst 3. The bulk fluorine content was 7.2 wt %. Catalyst 3 was activated in atmospheric pressure $H_2$ by heating from room temperature to 343° C. in 4 hours followed by a hold at 343° C. for 2 hours.

Catalyst 4 is the same as catalyst 3 in all respects except that prior to the hydrogen activation step the material was heated at 400° C. in air for 3 hours.

Catalyst 5

One sixteenth inch alumina extrudates impregnated with platinum were obtained from a commercial supplier containing 0.6 wt. % platinum and 1% chlorine. The metal loaded extrudate was fluorided using a solution of $NH_4F$/HF at pH 4.2 by soaking. The soaked material was washed, then dried/heated for 2 hours at

TABLE 3

Dewaxing of Conventional Stocks
150 Neutral - 5.4 cSt @ 100° C. lube fraction

| Feed Crude Source | DWO VI[1] | Filtration Temp °C. | Dewaxer Feed Wax Content % | Pour Point °C. | Cloud Point °C. | Feed Filter Rate $m^3/m^2d$ | Wax Cake L/S v/v | Dilution Ratio v/v | MEK/MIBK v/v |
|---|---|---|---|---|---|---|---|---|---|
| South La. | 90 | −20 | 9–10 | −18 | 28 | 6.6 | 8.8 | 2.5 | 40/60 |
| North La. | 105 | −21 | 19–22 | −18 | 31 | 11.0 | 4.6 | 2.8 | 40/60 |

[1]Both stocks extracted using N-methyl pyrolidone to the maximum possible Viscosity Index.
[2]Solvent composition required for miscible filtration at the filtration temperatures shown are typically MEK/MIBK, 60/40 for both stocks.

EXAMPLE 4

Catalysts 2 to 7

In the following runs the isomerate was made from slack wax obtained by solvent dewaxing a 600N oil. The 400° C. in air. Fluorine content was found to be 7.0 wt %, and the surface N/Al=0.0037 by X-ray photo spectroscopy. Catalyst 5 was activated by heating in 50 psi flowing $H_2$ as follows: room temperature to 100° C. in 2 hrs., hold for 1 hr., 100° C. to 450° C. in 3 hrs., hold for 4 hrs. For the sample of catalyst 5 charged to the small unit (b) used in the reported in Table 4, the final activation condition was 400° C. for 0.75 hours.

TABLE 4

| | Catalyst | | | | | | | | | |
|---|---|---|---|---|---|---|---|---|---|---|
| Unit* | 1 (a) | 1 (b) | 2 (a) | 2 (a) | 3 (a) | 4 (a) | 5 (a) | 5 (b) | 6 (b) | 7 (b) |
| Cat Charge (cc) | 200 | 80 | 3600 | 200 | 50 | 50 | 200 | 80 | 80 | 80 |
| Flow | Up | Down | Down | Up | Up | Up | Up | Up | Down | Down |
| Catalyst Inspections | | | | | | | | | | |
| N/Al by XPS | | | | | 0.0012 | 0.0013 | | | | |
| Hydrate level | | | | | 100 | 60 | | | | |
| N/Al level (after activation) | | | | | 0.0011 | 0.0013 | | | | |
| Hydrate level (after activation) | | | | | 66 | 57 | | | | |
| Isomerization Conditions | | | | | | | | | | |
| Temp °C. | 347 | 320 | 323 | 318 | 313 | 315 | 340 | 320 | 310 | 320 |
| Pressure (psi $H_2$) | 1000 | 1000 | 1000 | 1000 | 1000 | 995 | 1000 | 1000 | 1000 | 1000 |
| LHSV (v/v/h) | 0.9 | 0.9 | 1.0 | 1.0 | 0.45 | 0.45 | 0.9 | 0.9 | 0.9 | 0.9 |
| Gas rate (SCF/bbl, $H_2$) | 5000 | 5000 | 5000 | 5000 | 5000 | 5000 | 5000 | 5000 | 5000 | 5000 |
| Dewaxed 370° C.+ Oil Yield (Wt. % on feed) | 56.0 | 52.0 | 51.0 | 45.0 | 47.1 | 51.7 | 50.0 | 48.0 | 39.0 | 51 |
| 370° C.−, Conversion (wt. % on feed) | 29.0 | 22.0 | 29.0 | 29.0 | 36.1 | 18.7 | 23.8 | 20.7 | 37.3 | 28.7 |

*(a) = continuous pilot unit
(b) = small lab unit.

Catalyst 6 was prepared by meshing the dried/heated form of Catalyst 5 to a particle size of 1/30" (14/35 mesh). After meshing to a particle size of 1/30" (14/35 mesh), Catalyst 6 was activated in flowing hydrogen by heating from room temperature to 100° C. over a 2 hour period, holding at 100° C. for 1 hour, heating from 100° to 450° C. over a 3 hour period, holding at 450° C. for 1 hour. Activation pressure was 50 PSI.

Catalyst 7 1/16" $Al_2O_3$ extrudates were impregnated with chloroplatinic acid to a level of 0.26% pt. The extrudates were then sized and screened to 1/30" mesh and subsequently fluorided using a 10 fold excess of 1.6 wt % aqueous HF by immersion for 4 hrs at ambient temp. The resulting catalyst was washed in a 30 fold excess of $H_2O$ and dried at 130° C. for 16 hrs. The catalyst was not calcined. The fluorine content was found to be 8.5 wt %. Activation procedure was the same as employed for Catalyst 1 (See Example 1).

Table 4 presents comparisons of these catalysts on slack wax from 600N oil. Conditions are recited under which the catalysts were run. Dewaxed oil yields were determined by using the test method ASTM D-3235 on the 370° C.+ fraction.

This example demonstrated that Catalyst 1 is unexpectedly superior to the extrudate form of the HF treated catalyst (Catalyst 2), even when Catalyst 2 is run at high mass velocity.

The importance of using the low pH halogenation media is also demonstrated, compare Catalyst 4 with Catalyst 6, when each was run in a small unit in the down flow mode, clearly, sizing down the particles does not always improve selectivity; it is only an advantage if fluoriding was originally performed at low pH (e.g.<4) using for example HF. The performance of Catalyst 7 of Table 4 also illustrates that the catalyst can be sized before fluoriding. Good selectivity again results when the low pH fluoriding media is used.

Table 4 also demonstrates the importance of the catalyst having a hydrate level of 60 or less. Catalyst 3 possesses a hydrate level of about 66 and is seen to be inferior to catalyst 4 which is identical except that the hydrate level is lower (57). Catalyst 4 produces a higher yield of 370+ C.+ oil than does Catalyst 3.

EXAMPLE 5

Catalysts 8 and 9 and Comparison Catalysts 1,2,3 and 4.

In these Examples the hydrotreated 600N slack waxes are those previously described in Example 4. Following isomerization in an upflow once through mode of operation the isomerate was fractionated to obtain the 370+ C.+ lube fraction.

Dewaxed oil yields were determined using the ASTM Test D-3235 method on the 370° C.+ fraction.

In this Example a series of catalysts was prepared using the $NH_4F/HF$ fluoriding procedures described above. Examples of superior catalysts made using the $NH_4F/HF$ fluoriding procedures were seen to have surface fluorine content in the low recited desirable range. Results for these catalysts are shown in Table 5. Less satisfactory catalysts made using $NH_4F/HF$ treatment are shown in Table 6. These catalysts all contained high levels of surface fluorine resulting from initial excessive loading of bulk fluorine when using pH 4 or greater. In the case of comparison Catalyst 3, while the bulk fluorine level is within the desired range and surface fluorine was initially low in the as charged catalyst, the excessively severe activation conditions employed subsequently increased the surface fluorine level of the catalyst. This we believe is the reason for its poorer selectivity. All catalysts were dried and heated as reported in Tables 5 and 6.

TABLE 5

Examples of Good Catalysts in the Process of the Invention

| | Catalyst | | |
|---|---|---|---|
| | 8 | 9 | 9 |
| Catalyst Charge (cc) | 50 | 50 | 200 |
| Method of fluoride treat | $NH_4F/HF$ | $NH_4F/HF$ | $NH_4F/HF$ |
| Drying conditions °C. | 400 (muffle) | 400 | 400 rotary kiln |
| Catalyst Inspections | | | |
| N/Al by XPS | 0.0037 | 0.0021 | 0.0021 |
| Hydrate level | 29 | 24 | 24 |
| F. (wt %) (bulk) | 6.9 | 7.0 | 7.0 |
| F wt % (surface) | 1.7 | 2.0 | 2.0 |
| Hydrogen Activation | | | |

TABLE 5-continued

| Examples of Good Catalysts in the Process of the Invention | Catalyst | | |
|---|---|---|---|
| | 8 | 9 | 9 |
| Times, hrs. | | | |
| RT. to final temp | 7 | 4 | 7 |
| Time at T | 2 | 2 | 2 |
| Final T, °C. | 343 | 343 | 350 |
| Hydrogen Activation Pressure | ambient | ambient | 50 psi |
| Isomerization Conditions | | | |
| Temp. °C. | 310 | 312 | 309 |
| LHSV (v/v/h) | 0.45 | 0.45 | 1.0 |
| Press. PSI $H_2$ | 1000 | 1000 | 1000 |
| Gas rate (SCF/B, $H_2$) | 5000 | 5000 | 5000 |
| Max 370° C.+ oil | 50(1) | 49.8 | 49.3 |
| Dewaxed oil yield, (wt % on feed) | | | |
| Conversion to 370° C.− (wt % on feed) | 28 | 24.5 | 35.2 |

(1)Interpolated data

TABLE 6

| Performance of Comparative Catalysts | Catalyst | | | |
|---|---|---|---|---|
| | 'Comparison 1 | Comparison 2 | Comparison 3 | Comparison 4 |
| Unit Type | Continuous Pilot Unit | | | |
| Method Treat | $NH_4F/HF$ | $NH_4F/HF$ | $NH_4F/HF$ | $NH_4F/HF$ |
| drying conditions, °C. | 400 (rotary kiln) | 400 (muffle) | 400 (rotary kiln) | 400 (muffle) |
| Catalyst Inspections | | | | |
| N/Al by XPS | 0.010 | 0.013 | 0.0021 | 0.0040 |
| F. wt % | 6.8 | 5.6 | 7.0 | 6.9 |
| F, wt % (surface) | ~10 | ~5 | * | 7 |
| Hydrate level | 39 | <10 | 24 | <10 |
| Hydrogen Activation Times, hr. | | | | |
| RT to 100 C., @ 100° C. | 2,1 | 2,1 | 3,6 | 2,1 |
| to final temp (T) | 2 | 2 | 42 | 2 |
| time at T | 1 | 1 | 3 | 1 |
| Final T °C. | 350 | 350 | 400 | 350 |
| Hydrogen Activation pressure # | 50 | 50 | 300 | 50 |
| Isomerization Conditions | | | | |
| Temp., °C. | 310 | 300 | 305 | 310 |
| LHSV (v/v/hr) | 0.90 | 0.90 | 1.0 | 0.90 |
| Pressure psi $H_2$ | 1000 | 1000 | 1000 | 1000 |
| Gas rate (SCF $H_2$/bbl) | 5000 | 5000 | 5000 | 5000 |
| Dewaxed Oil yield, (wt % on feed) | 44.0 | 45.0 | 45 | 48.5 |
| 370° F. (wt % on feed) | 26.1 | 24.1 | 21.8 | 30.1 |
| Unconverted Wax (wt % on feed) | 29.9 | 30.9 | 33.2 | 21.4 |

* F. at surface measured 2.0 before activation and approximately 7 after activation

EXAMPLE 6

The presence of oil in the wax has been found to produce an enhanced VI product as compared to oil free wax when isomerization is performed utilizing the preferred "sized" catalyst made employing HF. The amount of oil in the wax, however, must fall within a particular range as previously described, if this enhanced VI phenomenon is to be obtained.

A meshed platinum on fluorided alumina catalyst (Catalyst 1 from Example 1) was used to isomerize a slack wax obtained from 600N oil. The wax samples had oil contents of <1%, about 7% and about 23%. The wax containing less than about 1% oil was made by recrystallizing a 600N slack wax by warm-up deoiling then hydrotreating. This 1% oil was has 99% saturates, 0.8% aromatics and 0.2% polar compounds (as determined by silica gel separation). It had an initial boiling point of 382° C. and a 99% off boiling point of 588° C., as determined y GCD. Subsequently, isomerized products were dewaxed to between −18 to −21° C. pour. Fractionation of the products showed that at the higher viscosity range the isomerate made from wax possessing about 7% oil exhibited an unexpected VI enhancement as compared to the other wax samples having <1% and 23% oil. This is to be compared with the results obtained using an extrudate $Pt/FAl_2O_3$ catalyst.

Comparison Catalyst 4 was used to isomerize slack waxes obtained from 600N oil, which slack waxes contained <1%, 10.9% and 22% oil under conditions selected to achieve the levels of conversion indicated in Table 7. Comparing the results obtained using Catalyst 1 with those obtained using Comparison Catalyst 4 one sees that isomerization utilizing the meshed catalyst (Catalyst 1) exhibits an unexpected VI enhancement when the wax feed employed contains about 7% oil.

From the above it is clear that the sized catalyst is preferred for use in the isomerization process described herein. Reference to FIG. 3 shows that Catalyst 1 has the highest selectivity for oil production making it a preferred catalyst (Catalyst I of the Figure).

TABLE 7

| Example of Unexpected VI Enhancement using Meshed Catalyst on Wax Containing ~ 10% oil | | | | |
|---|---|---|---|---|
| Catalyst | Oil Content of Wax | Conv. to 370° C.− | Vis. @ 100° C. | VI |
| 1 | <1 | 13 | 4.8 | 148 |
| | 7 | 24 | 4.8 | 150 |
| | 23 | 12.8 | 4.8 | 135 |
| | 23 | 25.8 | 4.8 | 137 |
| Comparison Cat 4 | <1 | 19.3 | 4.8 | 147 |
| | | 35.0 | 4.6 | 142 |
| | 10.9 | 26.8 | 4.9 | 143 |
| | 22 | 28.8 | 5.0 | 139 |
| | | 48.6 | 4.6 | 136 |

EXAMPLE 7

Slack wax from Bright Stock containing 15% oil was hydrotreated over Cyanamid's HDN-30 catalyst at 399° C., 0.5 v/v/h, 1000 psi $H_2$ and 1500 SCF/B, $H_2$, yielding a hydrotreated slack wax with the following properties:

wax Oil content: 22.8 wt %
Sulfur = 3pp,
Nitrogen = < 1ppm

| Distillation Data GCD % off at °C. ibp, 255 | |
|---|---|
| 10 | 363 |
| 20 | 436 |
| 30 | 481 |
| 40 | 515 |
| 50 | 541 |
| 60 | 564 |
| 70 | 590 |
| 80 | 656 |

The hydrotreated slack wax was then isomerized over Catalyst 1 described in Example 1 to produce the following isomerate products:

| Isomerization Conditions: | Run 1 | Run 2 |
|---|---|---|
| Temperature, °C. | 332 | 332 |
| Pressure psi $H_2$ | 1000 | 1000 |
| Gas rate SCF/B, $H_2$ | 5000 | 5000 |
| LHSV (v/v/h) | 0.9 | 0.9 |
| Isomerate Product | A | B |
| Max 370° C.+ | 54.6 | 54.9 |

-continued

| | | |
|---|---|---|
| Dewaxed oil yield (wt % on feed) (by ASTM D3235 method) | | |
| Conversion to 370° C.−, (wt % on feed) | 28.4 | 27.6 |

The isomerate products A and B made from the Bright Stock slack wax were fractionated into a broad heart cut (from product A) and a narrow cut (from product B) and dewaxed using MEK/MIBK under conventional dilution chilling dewaxing conditions. This was a DILCHILL dewaxing operation run at 150 cm/sec. agitation top speed (2 inch agitator) at an outlet temp. of −13° C. Indirect chilling was then employed to get down to the filter temperature. From review of the data presented in Tables 8 and 8A it is apparent that fractionating the isomerate into a heart cut boiling between 370°-582° C. not only facilitated dewaxing the oil to the target pour point but permitted the dewaxing to be more efficient (i.e. higher filter rates) than with the narrow fraction. Higher yields of oil were obtained at good dewaxed oil filter rates on the broad heart cut as compared to narrow cut or 370° C.+ topped fractions dewaxed under the same conditions. (Compare runs 1 and 2 Table 8 with runs A, B and I, Table 8A). This shows the advantage of dewaxing the heart cut when dealing with isomerate obtained from very heavy, high boiling wax fractions operating on the heart cut permits dewaxing to be conducted under miscible conditions, Only when dealing with a broad heart cut can low pour points, high yields and good filter rates be simultaneously achieved.

TABLE 8

COMPARISON OF NARROW VERSUS BROAD HEART CUT DILUTION CHILLING DEWAXING PERFORMANCE FOR BRIGHT STOCK ISOMERATES

| Isomerate Boiling Range, °C.: | Broad Heart Cut 370–582 | | | | | |
|---|---|---|---|---|---|---|
| Run | 1 | 2 | 3 | 4 | 5 | 6 |
| Dewaxing Conditions: | | | | | | |
| Solvent Type: | MEK/MIBK | MEK/MIBK | MEK/MIBK | MEK/MIBK | MEK/MIBK | MEK/MIBK |
| Solvent Ratio, V/V | 10/9 | 20/80 | 20/80 | 20/80 | 30/70 | 0/100 |
| Dilution, Solv/Feed, V/V | | 4.3 | 4.1 | 4.1 | 4.3 | — |
| Filter Temperature, °C. | −25 | −25 | −30 | −35 | −35 | −25 |
| Miscibility | Miscible | Miscible | Borderline | Immiscible | Immiscible | Miscible |
| Feed Filter Rate, M3/M2 Day | 3.8 | 3.8 | 4.2 | 3.7 | 4.8 | 3.4 |
| Wax Cake Liquids/Solids, W/W | 7.7 | 9.4 | 8.4 | 10.5 | 10.5 | 8.3 |
| Wash/Feed, W/W | — | 1.0 | 1.1 | 1.0 | 0.88 | — |
| % Oil in Wax | 22 | 42 | 37 | 56 | 66 | 33 |
| Unconverted wax content, wt % | — | 21 | 23 | 25 | 25 | 21 |
| Theoretical DWO Yield, (100-WC), wt % | — | 79 | 77 | 75 | 75 | 79 |
| Dewaxed Oil Yield, wt. % | 73.1 | 63.8 | 63.5 | 43.2 | 26.5 | 68.7 |
| Dewaxed Oil Filter Rate, M3/M2 Day | 2.8 | 2.6 | 2.6 | 1.6 | 1.3 | 2.3 |
| Dewaxed Oil Inspections: | | | | | | |
| Viscosity, cSt | | | | | | |
| @ 40° C. | 25.5 | 25.30 | 25.75 | 24.49 | 22.67 | 25.7 |
| @ 100° C. | 5.31 | 5.28 | 5.34 | 5.15 | 4.87 | 5.34 |
| Viscosity Index | 147 | 147 | 147 | 146 | 143 | 147 |
| Pour, °C. | −20 | −20 | −26 | −32 | −32 | −20 |
| Cloud, °C. | −17 | −17 | −22 | −28 | −31 | −16 |

TABLE 8A

COMPARISON OF NARROW VERSUS BROAD HEART CUT DILUTION CHILLING DEWAXING PERFORMANCE FOR BRIGHT STOCK ISOMERATES

| Isomerate Boiling Range, °C.: | Narrow Cut 495–582 | | | | | Topped 370° C.+ |
|---|---|---|---|---|---|---|
| Run | A | B | C | D | E | I |
| Dewaxing Conditions: | | | | | | |
| Solvent Type: | MEK/MIBK | MEK/MIBK | MEK/MIBK | MEK/MIBK | MEK/MIBK | MEK/MIBK |
| Solvent Ration, V/V | 10/90 | 20/80 | 30/70 | 0/100 | 5/95 | 10/90 |

TABLE 8A-continued

COMPARISON OF NARROW VERSUS BROAD HEART CUT DILUTION CHILLING DEWAXING PERFORMANCE FOR BRIGHT STOCK ISOMERATES

| Isomerate Boiling Range, °C.: | | | Narrow Cut 495–582 | | | Topped 370° C.+ |
|---|---|---|---|---|---|---|
| Run | A | B | C | D | E | I |
| Dilution, Ratio, Solv/Feed, V/V | 4.3 | 4.5 | 3.9 | | | 4.2 |
| Filter Temperature, °C. | −25 | −25 | −25 | −25 | −25 | −25 |
| Miscibility | Miscible/ Borderline | Immiscible | Immiscible | Miscible | Borderline | Miscible/ Borderline |
| Feed Filter Rate, M3/M2 Day | 3.2 | 3.8 | 6.6 | 3.1 | 3.0 | 2.9 |
| Wax Cake Liquids/Solids, W/W | 5.1 | 6.9 | 6.8 | 6.1 | 5.6 | 5.9 |
| Wash/Feed, W/W | 1.19 | 1.08 | 0.87 | — | — | — |
| % Oil in Wax | 18 | 52 | 62 | — | — | 24 |
| Wax Content, wt. % | 29 | 29 | 30 | — | — | 28 |
| Theoretical DWO Yield, (100-WC), wt % | 71 | 71 | 70 | — | — | 72 |
| Dewaxed Oil Yield, wt. % | 64.6 | 39.6 | 21.1 | 65.3 | 65.8 | 63.2 |
| Dewaxed Oil Filter Rate, M3/M2 Day | 2.1 | 1.5 | 1.4 | 2.0 | 2.0 | 1.8 |
| Dewaxed Oil Inspections: | | | | | | |
| Viscosity, cst | | | | | | |
| @ 40° C. | 56.1 | 51.3 | 49.6 | 48.7 | 53.6 | 34.9 |
| @ 100° C. | 9.18 | 8.83 | 8.63 | 8.37 | 9.13 | 6.63 |
| Viscosity Index | 145 | 152 | 152.5 | 148 | 152 | 148 |
| Pour, °C. | −20 | −21 | −22 | −15 | −15 | −20 |
| Cloud, °C. | −15 | −14 | −17 | — | — | −18 |

EXAMPLE 8

Slack wax derived from a 600N oil was hydrotreated over KF-840, a Ni/Mo on alumina hydrotreating catalyst at 370° C., 0.33 LHSV, 1500 SCF $H_2$/bbl, 1000 psi $H_2$. The hydrotreated wax had a sulfur content of 6 wppm, a nitrogen content of <1 wppm, an oil content of 18.7 wt %, an initial boiling point of 233° C. and a 95% off boiling point of 338° C.

The slack wax was isomerized over Catalyst 2 in three runs at high mass velocity as described in Table 9.

TABLE 9

| | Run 1 | Run 2 | Run 3 |
|---|---|---|---|
| Pressure (psi) | 1200 | 1200 | 1200 |
| LHSV | 1.0 | 1.0 | 1.0 |
| gas rate SCF/bb, $H_2$ | 2500 | 2500 | 2500 |
| Temp °C. | 329 | 328.9 | 327.1 |

TABLE 9-continued

| | Run 1 | Run 2 | Run 3 |
|---|---|---|---|
| Yield (wt %) 370° C.− | 37.5 | 37.8 | 22.0 |
| Max 370° C.+ Oil* | 49.8 | 50.5 | 52.5 |
| residual wax | 12.7 | 11.8 | 25.5 |

*Oil yield determined using ASTM D-3235 test method

Isomerate from these three runs was combined to produce a feed to the dewaxer having a 370° C.− wt % on feed of 26.6. The feed was fractionated into a 370° C.+ fraction and 420° C.+ fraction and dewaxed under simulated DILCHILL conditions in the laboratory using the procedure described in Example 7. DILCHILL dewaxing was performed using two different solvent systems on the two above described fractions. The results are presented in Table 10, below:

TABLE 10

DILCHILL Dewaxing of 600 Neutral Slack Wax Isomerates Comparison of Two Solvent Systems

| Isomerate Fraction, °C. | 370° C. | | 420° C.+ | |
|---|---|---|---|---|
| Solvent Composition, v/v | MEK/MIBK 20/80 | MEK/Toluene 50/50 | MEK/MIBK 20/80 | MEK/Toluene 50/50 |
| Feed Cloud, °C. | 49 | 49 | 52 | 52 |
| Viscosity, cSt @ 100° C. | 5.2 | 5.2 | 5.2 | 5.2 |
| Filter Temp. °C. | −27 | −30 | −27 | −30 |
| Wt. % Wax Removed | 27.4 | 26.4 | 30.5 | 29 |
| Dewaxed Oil Properties | | | | |
| Pour, °C. | −24 | −21 | −24 | −21 |
| Cloud, °C. | −20 | −18 | −21 | −18 |
| Pour-Filter dT, °C. | 3 | 9 | 3 | 9 |
| Cloud-Filter dT, °C. | 7 | 12 | 6 | 12 |
| Viscosity, cSt @ | | | | |
| 40° C. | 22.9 | 23.2 | 28.5 | 28.9 |
| 100° C. | 4.92 | 4.94 | 5.68 | 5.72 |
| Viscosity Index | 144 | 144 | 143 | 144 |
| Feed Filter Rate, m3/m2, day | 4.7 | 4.4 | 5.3 | 4.7 |
| Wax Cake Liquids/ Solids, w/w | 6.8 | 7.3 | 5.8 | 6.1 |
| Dewaxed Oil Filter rate m3/m2 day | 2.9 | 2.7 | 2.9 | 2.7 |

Average Solvent/Feed dilution on all runs was 3.4 v/v on feed.

From this it can be seen that to achieve extremely low pour points, it is preferred to use MEK/MIBK as the dewaxing solvent.

What is claimed is:

1. A process for maximizing the yield of lube oil base stocks or blending stocks having a pour point of about −21° C. or lower and a viscosity index of about 130 and higher by the isomerization of wax said process comprising (1) isomerizing the wax in an isomerization unit over an isomerization catalyst, fractionating the total product from the isomerization zone into a lube fraction boiling in the lube boiling range and solvent dewaxing said fraction in a single dewaxing stage to produce a dewaxed oil at a pour/filter ΔT, which is, the difference in temperature between the pour point of the dewaxed oil and the filter temperature, of 9° C. or less wherein the isomerization step is practiced to a level of conversion such that between about 15 to 35% unconverted wax, calculated as (unconverted wax)/(unconverted wax+dewaxed oil)×100, remains in the fraction of the isomerate boiling in the lube boiling range sent to the solvent dewaxing unit, and (2) recovering a dewaxed lube oil product having a VI of at least 130 and a pour point of at least −21° C.

2. The process of claim 1 wherein the level of conversion is such that between about 20% to 30% unconverted wax, calculated as (unconverted wax)/(unconverted wax+dewaxed oil)×100, remains in the oil fraction of the isomerate boiling in the lube boiling range coming from the isomerization unit which is sent to the solvent dewaxing unit from which the aforesaid dewaxed oil is recovered.

3. The process of claim 1, or 2 wherein the isomerization process is conducted over a catalyst containing a hydrogenating metal component supported on a fluorided refractory metal oxide.

4. The process of claim 3 wherein the isomerization catalyst contains a Group VI metal, Group VIII metal or mixture thereof supported on a halogenated alumina.

5. The process of claim 4 wherein the halogenated alumina is fluorided alumina.

6. The process of claim 1, or 2 wherein the isomerization process is conducted at a temperature between about 270° to 400° C., at a pressure of 500 to 3000 psi $H_2$, a gas rate of 1000 to 10,000 SCF/b, and a space velocity in the range 0.1 to 10 v/v/hr.

7. The process of claim 1, or 2 wherein the wax which is fed to the isomerization unit is a slack wax which has been hydrogenated so as to contain about 1 to 5 ppm nitrogen, about 1 to 20 ppm sulfur and has been deoiled to contain 0 to 35 wt % oil.

8. The process of claim 1, or 2 wherein the isomerate from the isomerization zone is fractionated into a lube oil fraction boiling in the 330° C.+ range.

9. The process of claim 8 wherein the isomerate from the isomerization zone is fractionated into a lube oil fraction boiling in the 370° C.+ range.

10. The process of claim 1, or 2 wherein the isomerate from the isomerization zone is fractionated into a lube oil fraction boiling in the about 330° and 600° C. range.

11. The process of claim 1 or 3 wherein the solvent dewaxing step is practiced using a solvent selected from the group consisting of $C_3$–$C_6$ ketones and mixtures thereof, $C_6$–$C_{10}$ aromatic hydrocarbons, mixtures of $C_3$–$C_6$ ketones and $C_6$–$C_{10}$ aromatic hydrocarbons, and liquified, normally gaseous $C_2$–$C_4$ hydrocarbons.

12. The process of claim 1, or 2 wherein the solvent dewaxing step is practiced using a mixture of methyl ethyl ketone (MEK) and methyl isobutyl ketone (MIBK) in a ratio of 20/80 at a temperature in the range −25° to −30° C.

13. The process of claim 1, or 2 wherein the solvent dewaxing step is practiced using methyl-isobutyl ketone.

14. The process of claim 9 wherein the solvent dewaxing step is practiced using a mixture of MEK and MIBK in a ratio of 20/80 at a temperature in the range −25° to −30° C.

15. The process of claim 10 wherein the solvent dewaxing step is practices using a mixture of MEK and MIBK in a ratio of 20/80 at a temperature in the range −25° to −30° C.

16. The process of claim 1, or 2 wherein unconverted wax recovered in the dewaxing step is recycled the isomerization zone.

17. The process of claim 10 wherein the fraction boiling above about 600° C. is recycled to the isomerization zone.

* * * * *